US006615412B1

(12) United States Patent
Hammond

(10) Patent No.: US 6,615,412 B1
(45) Date of Patent: Sep. 9, 2003

(54) FLIP YOUR LID AND TOILET SEAT OPENER

(75) Inventor: Stephen John Hammond, Annapolis, MD (US)

(73) Assignee: Stephen J. Hammond, Annapolis, MD (US)

( * ) Notice: Subject to any disclaimer, the term of this patent is extended or adjusted under 35 U.S.C. 154(b) by 0 days.

(21) Appl. No.: 10/055,329

(22) Filed: Jan. 25, 2002

(51) Int. Cl.[7] ..... A47K 13/10
(52) U.S. Cl. ..... 4/246.1; 4/246.3; 4/246.4
(58) Field of Search ..... 4/246.1, 246.3, 4/246.4, 246.5

(56) References Cited

U.S. PATENT DOCUMENTS

| | | | | | |
|---|---|---|---|---|---|
| 1,276,472 | A | | 8/1918 | Zeen | |
| 2,136,684 | A | | 6/1938 | Greavu | |
| 2,632,896 | A | * | 3/1953 | Morikawa | 4/246.1 |
| 3,504,385 | A | | 4/1970 | Fields | |
| 4,534,073 | A | * | 8/1985 | Smith | 4/246.4 |
| 4,592,097 | A | * | 6/1986 | Zimmerman | 4/246.4 |
| 4,736,470 | A | * | 4/1988 | Classon | 4/246.4 |
| 4,807,307 | A | * | 2/1989 | Sato et al. | 4/246.4 |
| 5,488,743 | A | * | 2/1996 | Alfonso | 4/246.3 |
| 5,594,958 | A | | 1/1997 | Nguyen | |
| 5,852,833 | A | * | 12/1998 | Gregoire | 4/246.3 |
| 5,857,223 | A | * | 1/1999 | Ferdinand | 4/246.1 |
| 5,875,498 | A | | 3/1999 | Joseph | |

* cited by examiner

*Primary Examiner*—Gregory L. Huson
*Assistant Examiner*—Amanda Flynn

(57) ABSTRACT

A no hands toilet lid and seat opening and closing mechanism designed to be disposed on a typical existing toilet having a seat and/or lid and seat. A saddle-like mounting bracket having left and right brackets is positioned on the top rear quadrant of the toilet bowl, and is clamped in place between the hinge assembly and toilet bowl. Two pivot arms support foot levers that control the lid and seat, and are pivotally coupled to the mounting brackets. A lid coiled spring and a seat coiled spring are each disposed around a pivot arm. U-shaped lid and seat brackets are adapted to be bonded to the existing toilet lid and seat, and are functionally connected to the lid and seat pedals, such that foot pressure forcing downward on a chosen pedal will raise and open the lid and/or seat.

2 Claims, 8 Drawing Sheets

FLIP YOUR LID AND TOILET SEAT OPENER

BACKGROUND OF THE INVENTION

The current invention is devised to permit the "no hands" ability to raise and lower toilet lids and seats by use of foot levers. Concern to avoid unsanitary contact with toilet lids and seats, and being exposed to harmful germs and bacteria, have given way to the introduction of many lid and seat lifting devices. Several examples of the prior art are noted in the following U.S. Patents:

U.S. Pat. No. 1,276,472 to Zeen discloses devices for raising and lowering water closet seats and lids.

U.S. Pat. No. 2,136,684 to Greavu discloses a raising and lowering mechanism for the seat or cover of the bowl.

U.S. Pat. No. 3,504,385 to Fields discloses a foot operable toilet seat-lifting device.

U.S. Pat. No. 5,594,958 to Nguyen discloses a hands-off toilet seat lifting apparatus.

U.S. Pat. No. 5,875,498 to Joseph discloses a toilet seat lifting device for raising and lowering a toilet seat.

The simple application of foot levers to the mounting brackets applied to a toilet having a seat or lid and seat is the greatest improvement of the current invention over the prior art, which in most cases requires foot lever bases to be mounted to the floor next to the toilet. The floor mounted foot lever devices are unsightly, take up space, and are difficult to maintain and clean, thus becoming a harbor for harmful germs and bacteria. Prior art U.S. Pat. No. 2,136, 684 describes an optional wall-mounted, hand operated seat-lifting device. The elimination of any hardware mounted to floors or walls noted in the prior art gives the current invention the advantage of being disposed entirely on a toilet having a seat or lid and seat, eliminating the chore of fastening fixtures to various forms of material found in floors and walls, requiring elaborate fasteners and in most cases, the use of power tools.

Another improvement of the current invention is the two bowl-mounted foot levers, which raise and lower the lid and seat evenly on both sides with the attached connecting rods. Prior art devices use arms, rods, sleeves, shafts and brackets from a single foot lever base to one side of the lid or seat. When pressure is applied to the foot levers, in turn pushing or pulling the arms, rods, sleeves, shafts and brackets, this causes a lopsided or unbalanced force on one side of the lid and seat, creating binding at the lid and seat hinges, promoting poor operation, resistance, wear and limited life span to the mechanism and lid/seat hinges.

Prior art U.S. Pat. Nos. 3,504,385, and 5,875,498 illustrate that activating the foot lever raises the lid and seat together, or the lid is first raised by hand before the seat is raised by the foot pedal, thus eliminating the total hands free concept. Another advantage of the current invention is the ability to raise or lower the lid and/or lid and seat by pressing on the chosen foot pedal, thus creating a total no hands solution.

Few parts and a less complicated design of the current invention make it economical to produce, simple to install, and easy to operate by young and old, especially by those for whom bending down, reaching or lifting creates discomfort or is not possible. The symmetrical design of the current invention sets it apart from the prior art, with the two tuned coiled springs applied to each foot lever, allowing the lid and seat to be raised with greater ease and to be lowered gently, with minimal banging of the tank or slamming of the bowl. In the event of a person with the loss of the ability to use their legs or feet, or confined to a wheelchair, the lid and seat can still be raised and lowered by hand with greater ease aided by the application of the coiled springs.

BRIEF SUMMARY OF THE INVENTION

The current invention promoting safe hygiene and convenience can now join other no hands devices, motion activated toilet/urinal flushers, blow dryers, and lavatory faucets in today's bathrooms, public or private, and can be installed on typical toilets having a seat or lid and seat, residential or commercial, past and present.

The experience of pain and discomfort from bending down and lifting, in addition to hygiene concerns, can now be relieved with the application of the current invention. With its few parts and practical design the Flip Your Lid and Toilet Seat Opener can be installed with most basic household tools, following simple instructions and possessing minimal skills.

The purpose of the current invention is to provide a high quality, low cost, proper functioning, easy installation, minimal maintenance, attractive, no hands device for raising smoothly and lowering gently the seat, or lid and seat, on any existing toilet having a seat or lid and seat. The downward pressure of one's foot on the chosen foot pedal forces the lever(s) downward uncoiling the coiled spring(s), forcing the connecting rods downward, thus activating the lid or seat bracket to force the lid or seat to pivot on the lid/seat hinge assembly, thus exposing the bowl without the use of one's hand. Again with the upward lifting of one's foot under the chosen foot pedal stirrup the process is reversed; the coiled spring(s) recoil, slowing the momentum of the lid or seat and once again the bowl is closed. Now there can be the luxury and convenience of raising and lowering toilet lids and seats with foot power, thus taking the worry away from coming in contact with harmful germs and bacteria by handling said items.

DETAILED DESCRIPTION OF THE INVENTION

Figure 1:
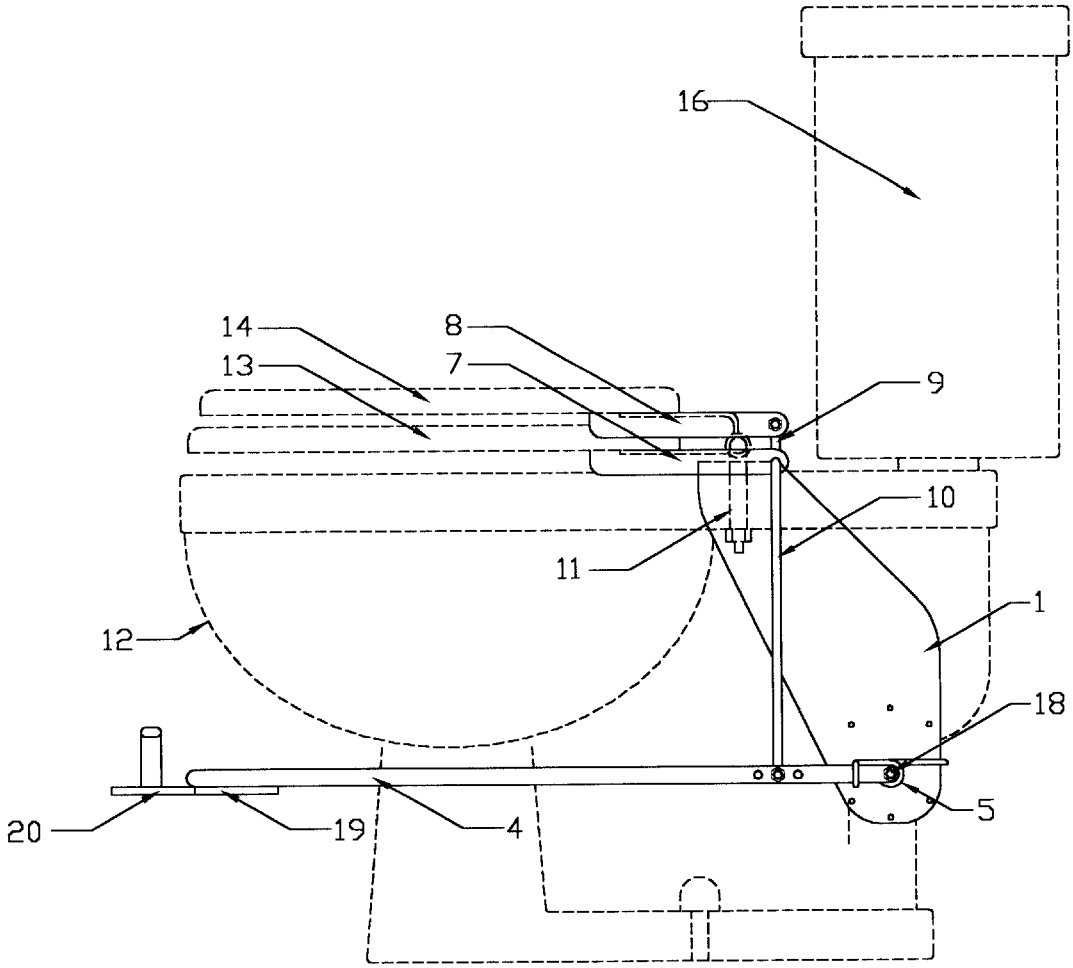
FIG. 1 is a left side view of typical toilet having a lid and seat with Flip Your Lid and Toilet Seat Opener in the closed position fastened on by lid/seat hinge bolts. Illustration depicts reference numbers pointing out components of current invention and said toilet.
Figure 2:
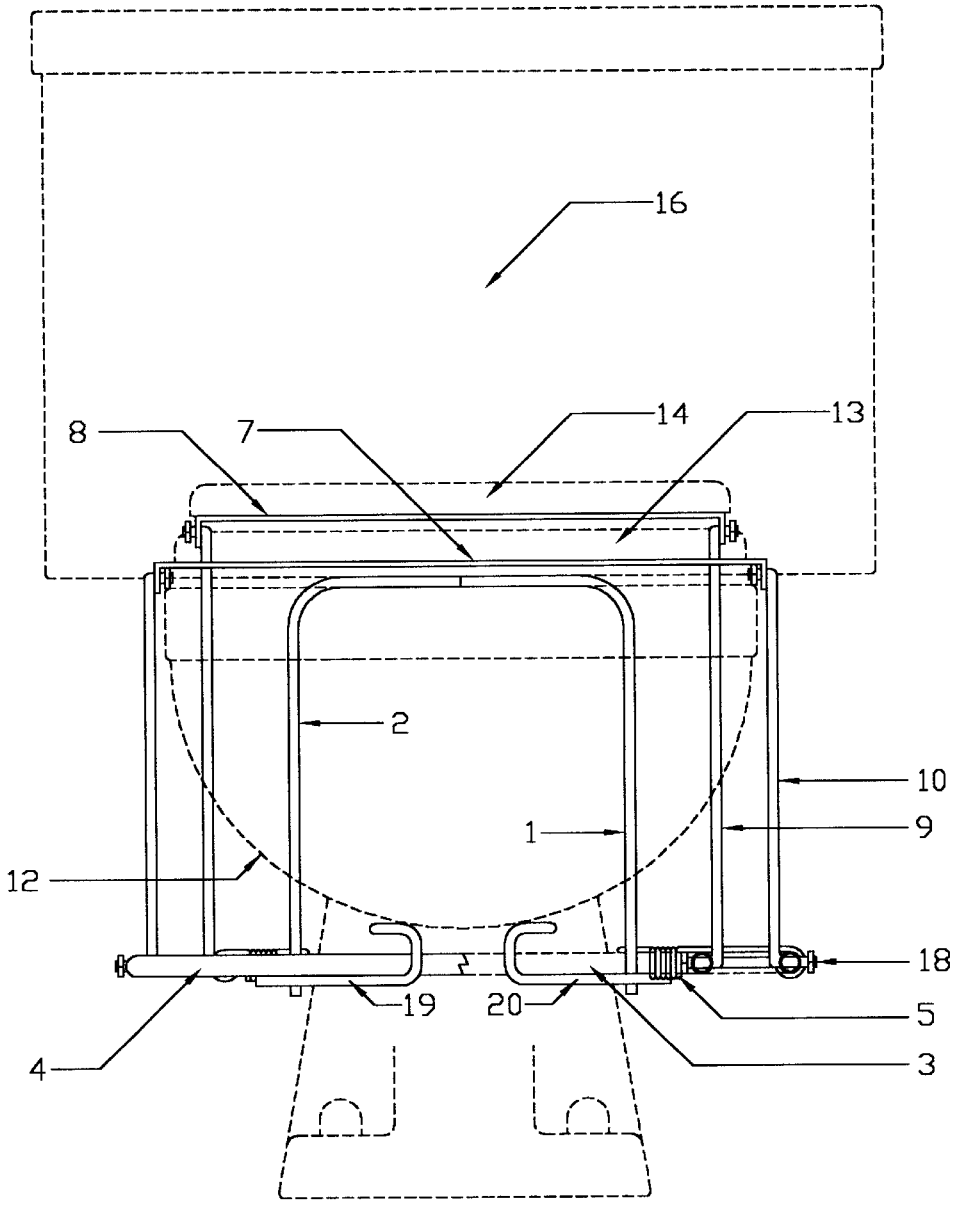
FIG. 2 is a front view of typical toilet having a lid and seat illustrating front half of foot levers cut away to expose left side connecting rods secured to foot levers and coiled spring disposed around pivot arm with first end coupled to foot lever and second end coupled to mounting bracket. Illustration depicts reference numbers pointing out components of current invention and said toilet.
Figure 3:
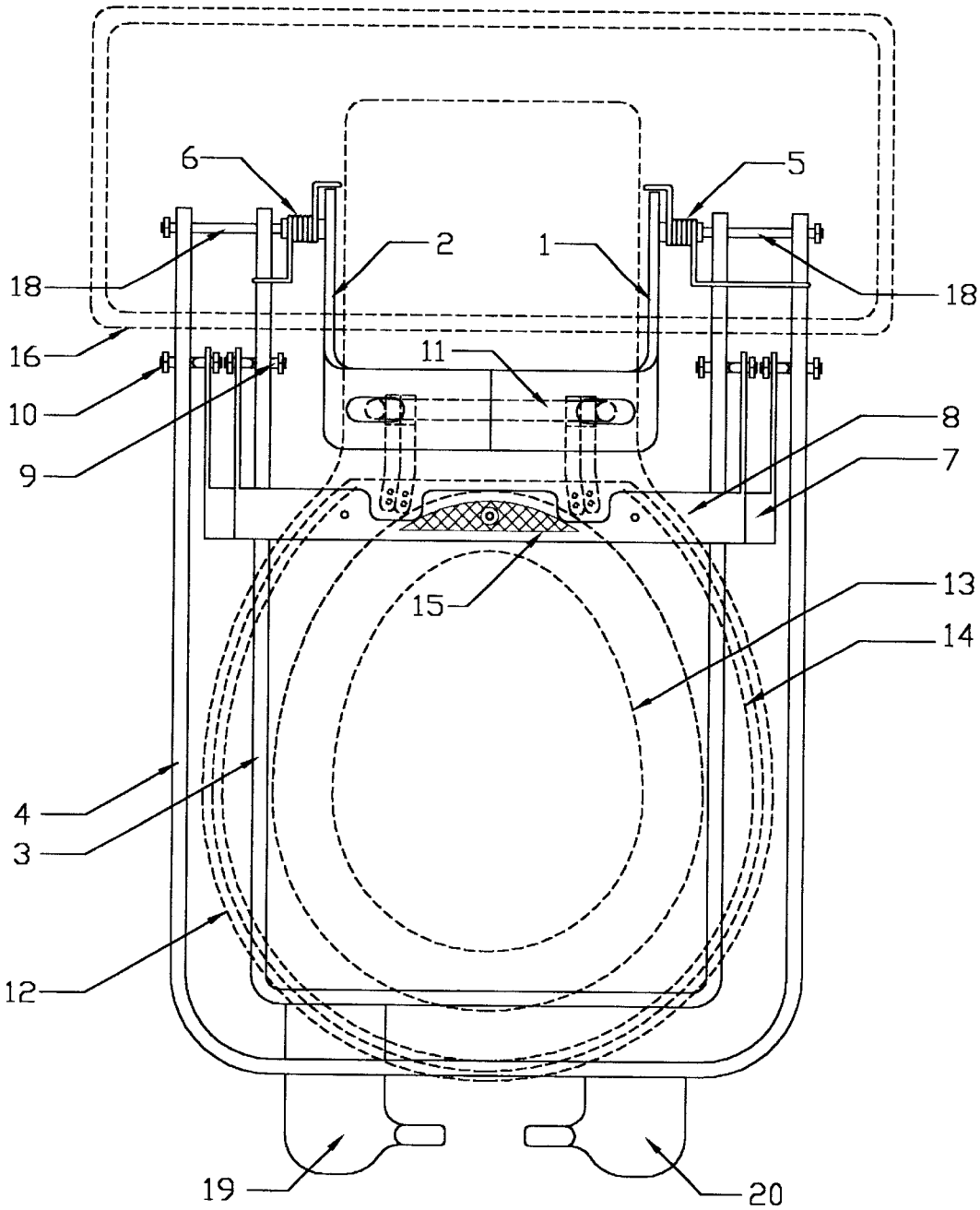
FIG. 3 is a top view of typical toilet having a lid and seat with Flip Your Lid and Toilet Seat Opener in the closed position fastened on by lid/seat hinge bolts. Illustration depicts reference numbers pointing out components of current invention and said toilet.

Drawings 1–3 depict various views of the current invention along with reference numbers to describe the components that make up the Flip Your Lid and Toilet Seat Opener. Also illustrated in the said drawings is a typical toilet (12) having a tank (16), a lid (14), a seat (13), and a lid/seat hinge assembly (11). A two piece saddle-like mounting bracket, comprising a left mounting bracket (1) and a right mounting bracket (2), each having a pivot arm (18) and each having an adjustable mounting hole, including holes for coiled spring tension adjustment, are positioned around said pivot arms (18). Mounting brackets (1, 2) are disposed on said toilet (12) by the removal of the lid/seat hinge assembly (11). Slotted adjustable mounting holes of the brackets are lined up over the existing hinge bolt holes in toilet bowl (12), thus allowing lid/seat hinge assembly (11) to be replaced, and securing mounting brackets (1, 2) firmly in place with said pivot arms (18) pointed outward from the sides of toilet (12). To dampen and aid in the raising and lowering of the lid (14) and seat (13), a seat coiled spring (5) is disposed around pivot arm (18) on left mounting bracket (1), and a lid coiled spring (6) is disposed around pivot arm (18) on right mounting bracket (2). The lid coiled spring (6) having two ends is adapted to work with lid foot lever (3), lid foot lever (3) having a lid foot pedal/stirrup (19). The first end of lid coiled spring (6) having a single coil is disposed around the right end of lid foot lever (3), and the second end is coupled to an optional tension adjustment hole in the right mounting bracket (2). A U-shaped lid foot lever (3) having two ends is positioned horizontally in front of the toilet base and under the toilet bowl (12), above the floor, with each end pivotally coupled to said pivot arms (18).

Seat coiled spring (5), having two ends, is adapted to work with seat foot lever (4), said seat foot lever having a seat foot pedal/stirrup (20). The first end of seat coiled spring (5), with a single coil, is disposed around the left end of seat foot lever (4). The second end traverses over foot lever (3) and is coupled to an optional tension adjustment hole in the left mounting bracket (1). A U-shaped seat foot lever (4), having two ends, is positioned horizontally in front of the toilet base, under the toilet bowl (12), and above the lid foot lever (3), each end pivotally coupled to said pivot arms (18). An upside down U-shaped lid bracket (8) having industrial strength adhesive (15) applied to its topside, and manufactured holes in top for additional typical screw fasteners with a manufactured hole located rearward on each side, is adapted for bonding to the underside rearward end of lid (14) in front of and parallel to lid/seat hinge assembly (11). An upside down U-shaped seat bracket (7) having industrial strength adhesive (15) applied to its topside, and manufactured holes in top for additional typical screw fasteners with a manufactured hole located rearward on each side, is adapted for bonding to the underside rearward end of seat (13) in front of and parallel to lid/seat hinge assembly (11). Two lid connecting rods (9) having two ends are positioned vertically, one on each side of toilet bowl (12), wherein a first upper end is pivotally coupled to the manufactured hole at a rearward side end in the lid bracket (8), and a second lower end is pivotally coupled to an optional manufactured hole in the lid foot lever (3). Two seat connecting rods (10) having two ends are positioned vertically, one on each side of toilet bowl (12), wherein a first upper end is pivotally coupled to the manufactured hole at a rearward side end in the seat bracket (7), and the second lower end is pivotally coupled to an optional manufactured hole in the seat foot lever (4).

Figure 4:
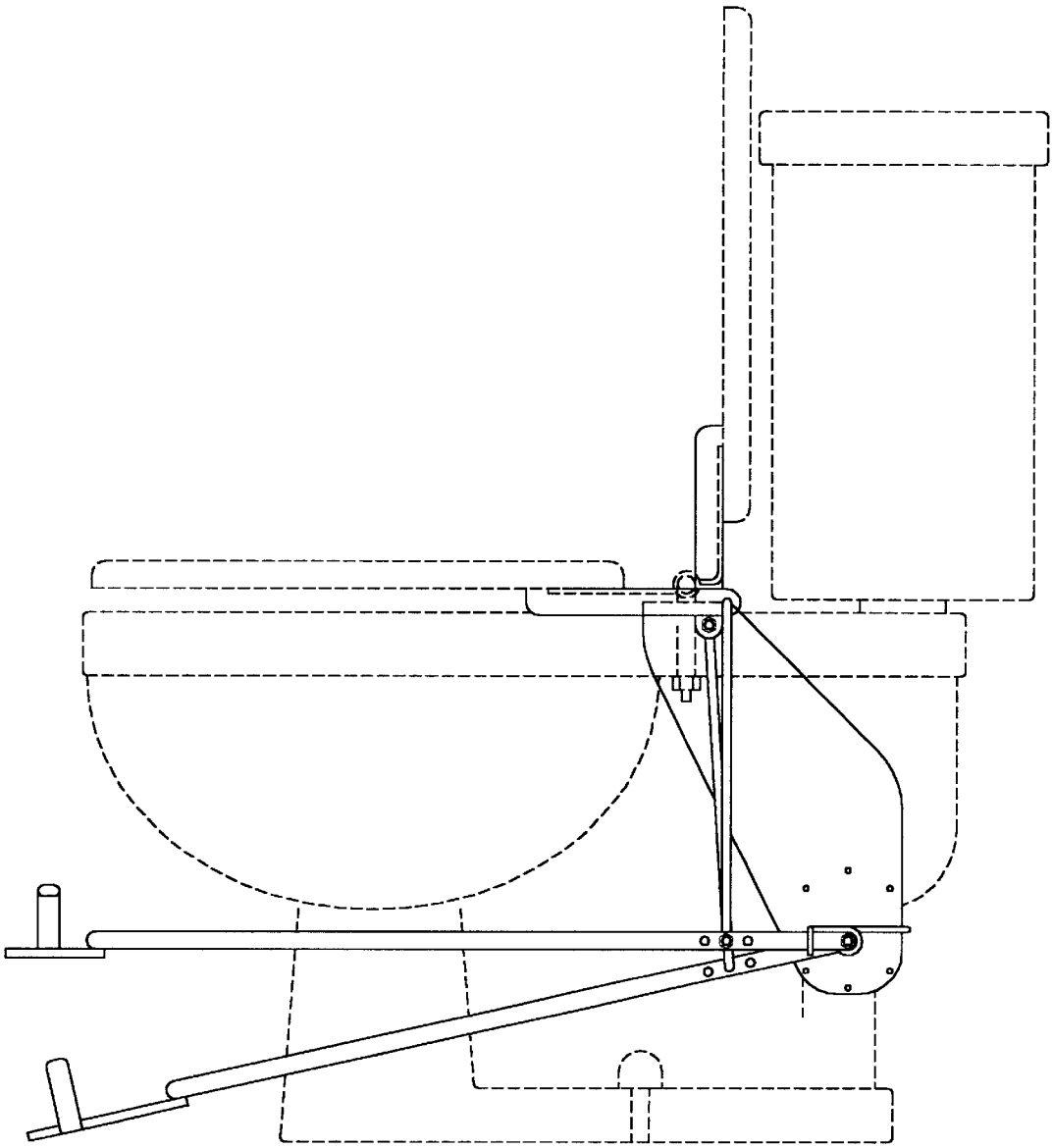
FIG. 4 is a left side view shown first in FIG. 1 with lid foot lever depressed, lid open and seat exposed.
Figure 5:
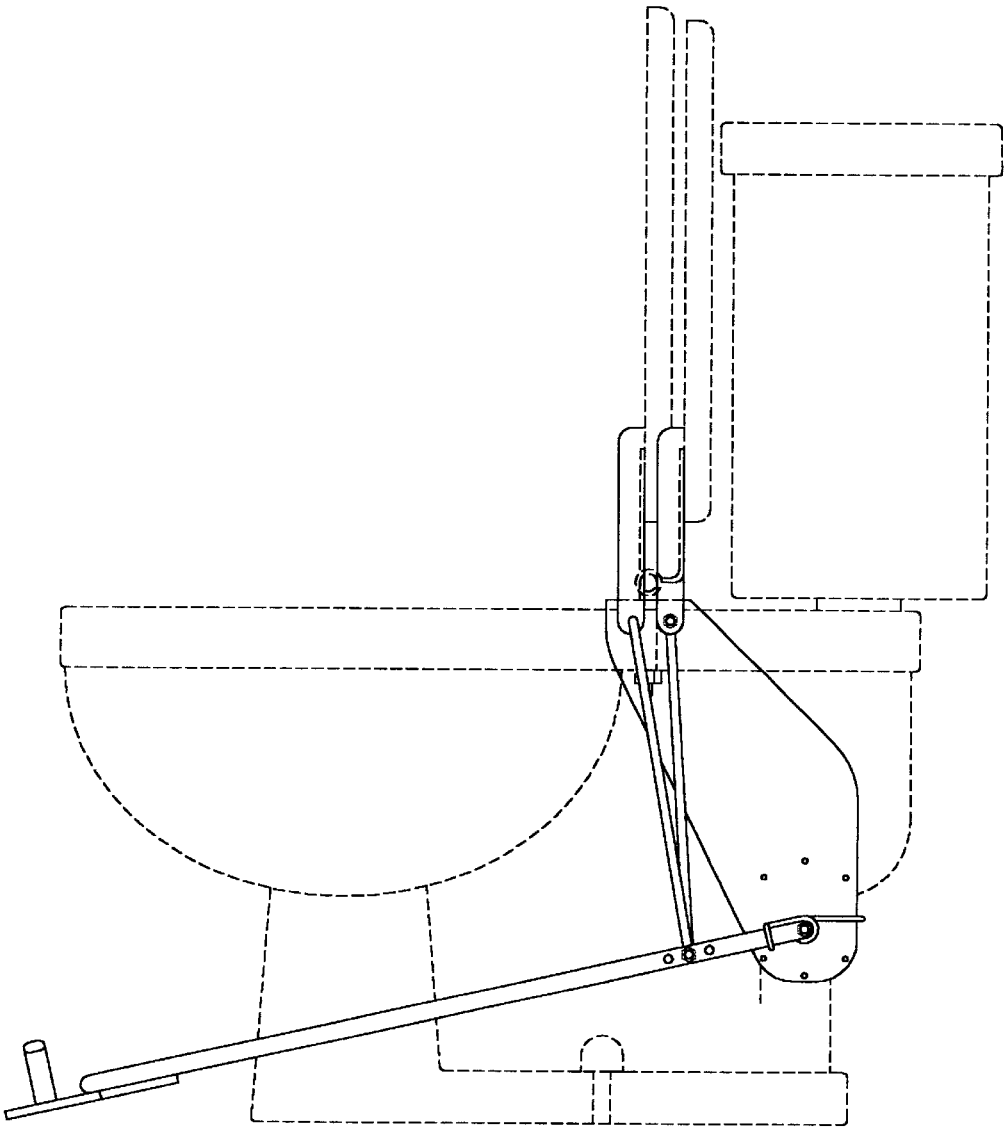
FIG. 5 is a left side view shown first in FIG. 1 with seat foot lever depressed, lid and seat open and toilet bowl exposed.
Figure 6:
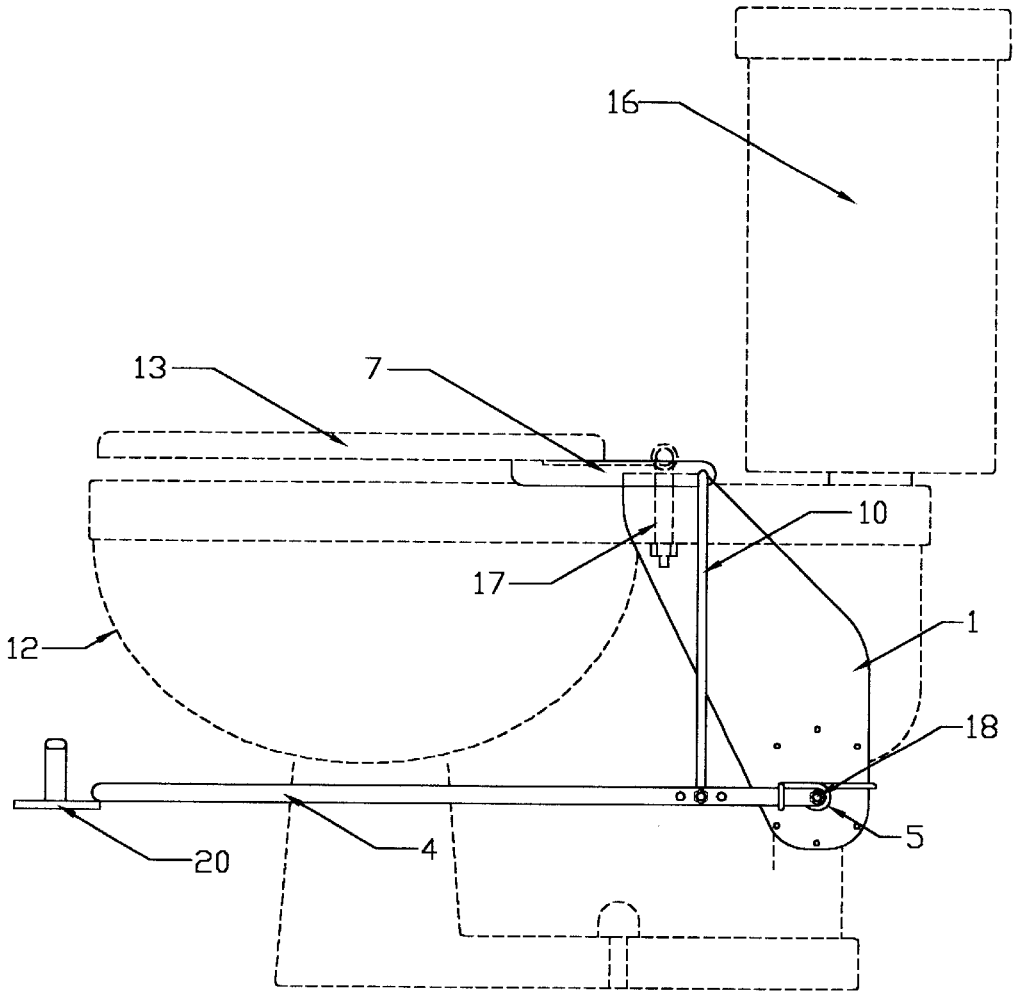
FIG. 6 is a left side view of typical toilet having a seat with Flip Your Lid and Toilet Seat Opener in the closed position, fastened on by seat hinge bolts. Illustration depicts reference numbers pointing out said toilet and components required to raise and lower the seat by the elimination of the components required to raise and lower the lid.
Figure 7:
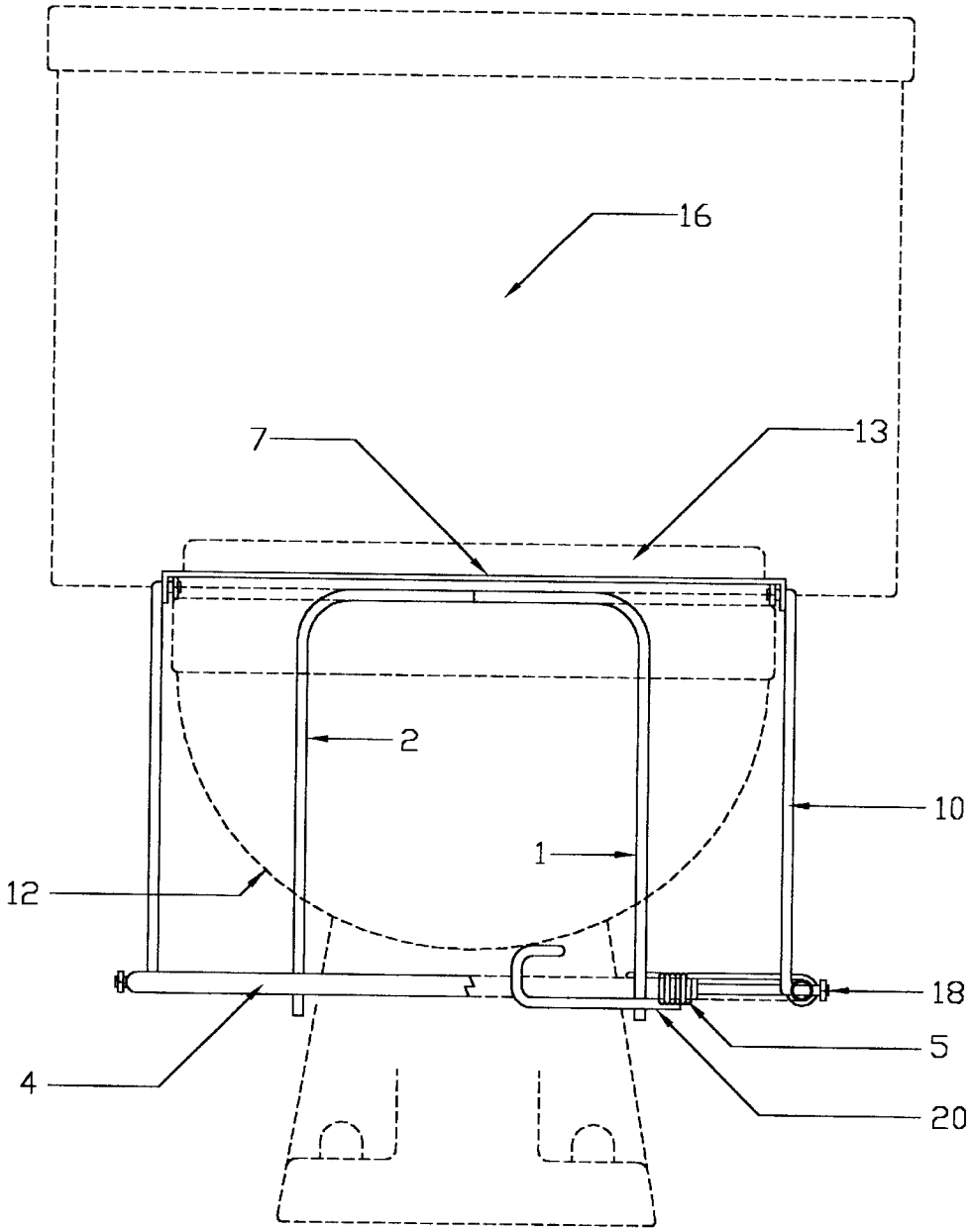
FIG. 7 is a front view of typical toilet having a seat illustrating front half of foot lever cut away to expose left side connecting rod secured to foot lever and coiled spring disposed around pivot arm with first end coupled to foot lever and second end coupled to mounting bracket. Illustration depicts reference numbers pointing out said toilet and components required to raise and lower the seat by the elimination of the components required to raise and lower the lid.
Figure 8:
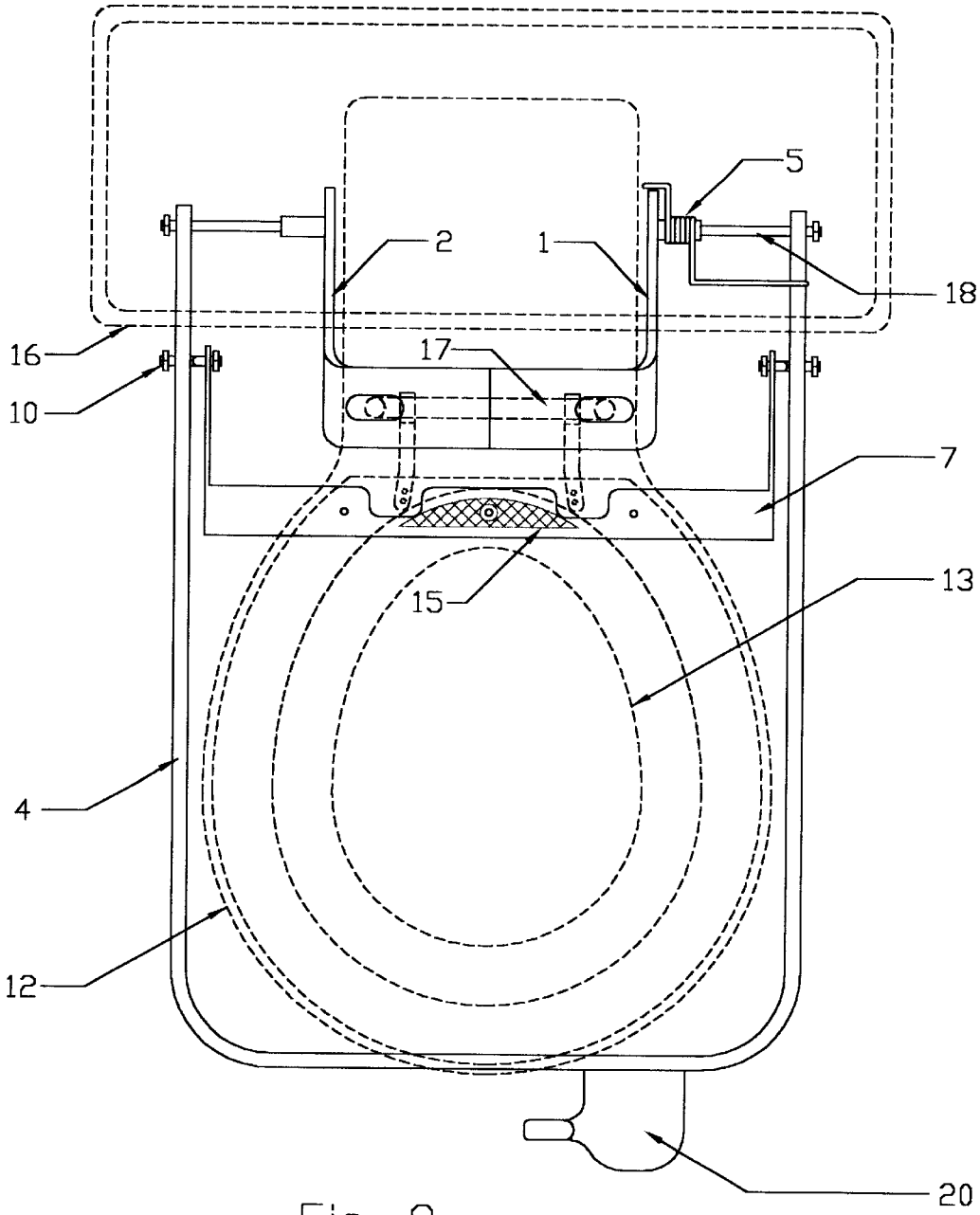
FIG. 8 is a top view of typical toilet having a seat with Flip Your Lid and Toilet Seat Opener in the closed position, fastened on by seat hinge bolts. Illustration depicts reference numbers pointing out said toilet and components required to raise and lower the seat by the elimination of the components required to raise and lower the lid.

Flip Your Lid and Toilet Seat Opener application is complete and ready for service. Forcing downward with foot pressure on lid foot pedal (19) attached to lid foot lever (3) forces lid coiled spring (6) to uncoil and lid connecting rods (9) move downward, pulling rear of lid bracket (8) downward forcing toilet lid (14) to pivot up on existing lid/seat hinge assembly (11), thus raising said lid with no hands (FIG. 4). To lower or close said lid, position foot under the stirrup applied to the lid foot pedal (19), and attached to said foot lever and raise lid foot lever (3) upward back to the horizontal position, thus reversing the raising process and therefore closing said lid with no hands. Forcing downward with foot pressure on seat foot pedal (20) attached to seat foot lever (4) is bound by design to force downward immediately on lid foot pedal (19) attached to lid foot lever (3) thus forcing coiled springs (5, 6) to uncoil and connecting rods (9, 10) downward, pulling rear of lid and seat brackets (7, 8) downward forcing toilet lid (14) and seat (13) to pivot up on existing lid/seat hinge assembly (11), thus raising said lid and seat with no hands (FIG. 5). To lower or close said lid and seat, position foot under the stirrup applied to lid foot pedal (19) and attached to lid foot lever (3) and raise said foot levers upward, back to horizontal position, thus reversing the raising process and therefore closing said lid and seat with no hands. To raise or open said seat with lid (14) in the raised or opened position, force downward with foot pressure on seat foot pedal (20) attached to seat foot lever (4) therefore opening said seat with no hands. To lower or close mid seat with lid (14) in the raised or opened position, position foot under the stirrup applied to seat foot pedal (20) and attached to seat foot lever (4) and raise said foot lever upward back to horizontal position thus reversing the raising process and therefore closing said seat, again with no hands.

In situations of a toilet having only a seat, the only components needed from the current invention for the no hands seat raising and lowering procedure are mounting brackets (1, 2), seat coiled spring (5), seat foot lever (4), seat bracket (7) and seat connecting rods (9), thus omitting lid coiled spring (6), lid foot lever (3), lid bracket (8) and lid connecting rods (9). Drawings 6–8 depict various views of the current invention, along with reference numbers to describe the components that make up Flip Your Lid and Toilet Seat Opener. Also illustrated in the said drawings is a typical toilet (12), having a tank (16), a seat (13), and a seat hinge assembly (17). A two-piece saddle-like mounting bracket comprising a left mounting bracket (1) and a right mounting bracket (2), each having a pivot arm (18) and each having an adjustable mounting hole, including holes for coiled spring tension adjustment are positioned around said pivot arms (18). Mounting brackets (1, 2) are disposed on said toilet (12) by the removal of seat hinge assembly (17). The slotted adjustable mounting holes are lined up over the existing hinge bolt holes in toilet bowl (12), thus allowing seat hinge assembly (17) to be replaced, securing mounting brackets (1, 2) firmly in place with said pivot arms (18) pointed outward from the sides of toilet (12). To dampen and aid in the raising and lowering of the seat (13), a seat coiled spring (5) is disposed around pivot arm (18) on left mounting bracket (1). Seat coiled spring (5) has two ends adapted to work with seat foot lever (4), seat foot lever (4) having a seat foot pedal (20). The first end of seat coiled spring (5) with a single coil is disposed around the left end of seat foot lever (4), and the second end is coupled to an optional tension adjustment hole in left mounting bracket (1). A U-shaped seat foot lever (4) having two ends, is positioned horizontally in front of the toilet base, under the toilet bowl (12) and above the floor, each end pivotally coupled to said pivot arms (18). An upside down U-shaped seat bracket (7) having industrial strength adhesive (15) is applied on the topside with manufactured holes in its top for additional typical screw fasteners with a manufactured hole located rearward on each side, is adapted for bonding to the underside rearward end of seat (13) in front of and parallel to seat hinge assembly (17). Two seat connecting rods (10) having two ends are positioned vertically, one on each side of toilet bowl (12). A first upper end is pivotally coupled to a manufactured hole at rearward side end in seat bracket (7), and a second lower end is pivotally coupled to optional manufactured hole in seat foot lever (4).

What is claimed is:

1. A toilet lid and seat raising and lowering mechanism adapted to be attached to an existing toilet having a toilet lid, seat, bowl and hinge assembly, said raising and lowering mechanism comprising;

a two piece saddle-like mounting bracket adapted to be attached to a toilet, wherein said mounting bracket has a left and a right bracket, each bracket having a pivot arm on its outward side pointed away from the toilet, wherein each mounting bracket is secured rearward on an existing toilet bowl rim at existing hinge bolt mounting holes, by existing hinge mounting bolts on said existing toilet, a first coiled spring tuned to dampen the momentum of said lid, disposed around the pivot arm attached to said right mounting bracket, said first coiled spring having two ends, the first end coupled to said right mounting bracket and the second end coupled to a lid foot lever, a second coiled spring tuned to dampen momentum of said seat, disposed around the pivot arm attached to the left mounting bracket, and said second coiled spring having two ends, the first end coupled to said left mounting bracket and the second end coupled to a seat foot lever, a first U-shaped lid foot lever, having a foot pedal/stirrup, adapted to activate said lid and having two ends pivotally coupled in a horizontal position under said toilet bowl, to said pivot arms, a second U-shaped seat foot lever, having a foot pedal/stirrup to activate said seat, and having two ends pivotally coupled in a horizontal position under said toilet bowl, to said pivot arms, a first upside down U-shaped lid bracket, adapted for bonding to the underside rear end of said lid, just in front of and parallel to said existing lid/seat hinge assembly, a second upside down U-shaped seat bracket, adapted for bonding to the underside rear end of said seat, just in front of and parallel to said existing lid/seat hinge assembly, a pair of lid connecting rods one on each side of said lid bracket and each of said connecting rods having two ends, the first end pivotally coupled at a rearward end of said lid bracket and in a vertical position, said second end pivotally coupled to said lid foot lever, a pair of seat connecting rods one on each side of said seat bracket and each of said connecting rods having two ends, the first end pivotally coupled at a rearward end of said seat bracket and in a vertical position, second end pivotally coupled to said seat foot lever.

2. A toilet seat raising and lowering mechanism adapted to be attached to an existing toilet having a toilet seat, bowl and hinge assembly, said raising and lowering mechanism comprising;

a two piece saddle-like mounting bracket adapted to be attached to a toilet, wherein said mounting bracket has a left and a right bracket, each bracket having a pivot arm on its outward side pointed away from the toilet, wherein said mounting brackets are secured rearward on an existing toilet bowl rim at existing hinge bolt mounting holes, by existing hinge mounting bolts on said existing toilet, having a hinged seat, a coiled spring tuned to dampen the momentum of said seat, disposed around said pivot arm attached to left mounting bracket, said coiled spring having two ends, the first end coupled to said left mounting bracket and the second end coupled to a seat foot lever, a U-shaped seat foot lever, having a foot pedal/stirrup, adapted to activate said seat and having two ends pivotally coupled in a horizontal position under said toilet bowl, to said pivot arms, an upside down U-shaped seat bracket, adapted for bonding to the underside rear end of said seat, just in front of and parallel to an existing seat hinge assembly, a pair of seat connecting rods, one on each side of said seat bracket, and each of said connecting rods having two ends, the first end pivotally coupled at a rearward end of said seat bracket and in a vertical position, said second end pivotally coupled to said seat foot lever.

* * * * *